United States Patent [19]

Grote

[11] Patent Number: 4,629,401

[45] Date of Patent: Dec. 16, 1986

[54] RADIAL PISTON PUMP

[75] Inventor: Walter Grote, Sprockhövel, Fed. Rep. of Germany

[73] Assignee: Hauhinco Maschinenfabrik G. Hausherr, Jochums GmbH & Co. KG, Essen, Fed. Rep. of Germany

[21] Appl. No.: 750,531

[22] Filed: Jun. 28, 1985

[30] Foreign Application Priority Data

Jul. 6, 1984 [DE] Fed. Rep. of Germany ..... 3424862

[51] Int. Cl.[4] ..... F04B 1/04; F16J 1/10

[52] U.S. Cl. ..... 417/273; 92/72; 92/129; 92/187

[58] Field of Search ..... 92/129, 72, 130 R, 187; 91/491; 417/273

[56] References Cited

U.S. PATENT DOCUMENTS

| | | | |
|---|---|---|---|
| 3,527,547 | 9/1970 | Dreter et al. | 417/273 |
| 3,670,630 | 6/1972 | Tyson | 92/129 |
| 3,828,653 | 8/1974 | Aldinger | 91/488 |
| 4,223,595 | 9/1980 | Ortelli | 417/273 |
| 4,534,711 | 8/1985 | Wakatsuki | 417/273 |

FOREIGN PATENT DOCUMENTS

| | | | |
|---|---|---|---|
| 1155336 | 10/1963 | Fed. Rep. of Germany . | |
| 1403748 | 1/1974 | Fed. Rep. of Germany . | |
| 2415884 | 10/1975 | Fed. Rep. of Germany | 417/273 |
| 2616192 | 10/1976 | Fed. Rep. of Germany | 417/273 |
| 2915239 | 10/1980 | Fed. Rep. of Germany . | |
| 2307144 | 10/1975 | France | 417/273 |
| 1344667 | 1/1974 | United Kingdom | 417/273 |
| 827834 | 5/1981 | U.S.S.R. | 92/129 |

*Primary Examiner*—Louis J. Casaregola
*Assistant Examiner*—Paul F. Neils
*Attorney, Agent, or Firm*—Karl F. Ross; Herbert Dubno

[57] ABSTRACT

Radial piston pump, particularly for liquids, comprising at least one radial cylinder, at least one radial piston with associated piston head, at least one piston guide shoe, at least one eccentric element, and a device for attachment of the radial piston with the piston guide shoe or shoes. The piston heads contact with their bearing surfaces the bearing surfaces of the associated piston guide shoe or shoes, but the piston heads are not attached with the piston guide shoes at their bearing surfaces. On the side not contacting the piston head the piston guide shoe contacts the eccentric element. The piston head has an outer shoulder, which is grasped by the device for attaching the radial piston with the piston guide shoe or shoes. This device comprises a connecting sleeve associated with each individual radial piston, which embraces with an inner flange the outer shoulder of the associated piston head. The connecting sleeve has an outer sealing shoulder adjacent the piston guide shoes, which grips the piston guide shoe or shoes. The connecting sleeve has on its end adjacent the radial piston a spring retaining ring, to which a spring holding ring on the associated radial cylinder is positioned opposite thereto and corresponds. Between the spring retaining ring and the spring holding ring a compressible spring is positioned, which surrounds the radial piston.

6 Claims, 3 Drawing Figures

RADIAL PISTON PUMP

FIELD OF THE INVENTION

My present invention relates to a radial piston pump, and, more particularly, to radial piston pumps for hydraulic media e.g. hydraulic fluids in hydraulic control or power systems, although water can also be used.

BACKGROUND OF THE INVENTION

Radial piston pumps of the prior art generally comprise at least one radial cylinder, at least one radial piston with associated piston head, at least one piston guide shoe, an eccentric element, and means for attaching the radial piston to the piston guide hose, whereby the piston head with its bearing surface contacts with or without locking or attachment the bearing surface of the associated piston guide shoe or shoes and the piston guide shoe or shoes contacts on its side not pressing on the piston head the eccentric element, and wherein the piston head has an outer shoulder, which is grasped by the device for attaching the radial piston to the piston guide shoe.

According to whether the eccentric element is an eccentric ring or an eccentric shaft, the radial piston is displaced by the eccentric or the cylinder carrier.

It is understood that such a radial piston pump has the usual passages for the guiding and control of liquids, which are not considered a part of the invention and therefore are not described although the references discussed below simply illustrate such means.

The drive or drive stroke can result from motion of the eccentric element or the housing; also the possibility exists to drive these elements with different speeds. (See, for comparison, German Pat. No. DE-PS 11 55 336, column 4, lines 31–51).

In known radial piston pumps of this kind (as taught in German Pat. No. DE-PS 29 15 239) the device for attachment of the radial piston with the piston guide shoe or shoes comprises a connecting ring running around the entire periphery of the radial piston pump, which is radially coupled with both the radial piston and also the eccentric element, whereby the coupling shoes are interconnected and the connecting ring runs concentrically with the motion of the eccentric element.

This may be implemented or performed with reasonable positioning and mounting effort only when the eccentric element is an eccentric ring, as is the case in the embodiments of the prior art. Of course one such connecting ring permits with an eccentric ring the abandonment of a locking attachment between the piston head and the piston guide shoes. However in fast running pumps increased wear and tear in the described structure occurs along the reciprocating path of the eccentric ring. Also one observes distortions in the connecting ring and fatigue fractures.

Inasmuch as the proportions are similar to one other radial piston pump (see, for example, German Pat. No. DE-PS 14 03 748), in which the radial pistons are provided with so clled piston pressure rings, which are positioned on both sides of the radial piston and engage or embrace both sides of the shoulder of the piston head, the drawbacks of the latter system must be considered. Here a locking attachment between the piston body and the piston guide shoes is necessary, which shows premature wear and tear and frequently likewise fatigue fracture.

OBJECTS OF THE INVENTION

The object of my invention is to provide a radial piston pump of the above described kind in which a direct attachment between the piston head and the piston guide shoe or shoes is not made, and further in the described way the peripheral connecting rings are no longer required, and the eccentric element can be constructed without difficulty, as one chooses, as an eccentric ring or an eccentric shaft.

It is another object of my invention to provide an improved radial piston pump.

It is also an object of my invention to provide an improved radial piston pump having reduced wear and tear in comparison to those of the prior art.

It is a further object of my invention to provide an improved radial piston pump having less fatigue fracture than those of the prior art.

It is yet another object of my invention to provide an improved radial piston pump in which the piston head and the piston guide shoe or shoes are not form locked together and thus attach directly to each other, and the eccentric element may be either an eccentric ring or an eccentric shaft.

SUMMARY OF THE INVENTION

These objects and others which will become apparent hereinafter are attained in accordance with my invention in a radial piston comprising at lease one radial cylinder, at least one radial piston with an associated piston head, at least one piston guide shoe, at least one eccentric element and a device for attaching the radial piston to the piston guide shoes or shoe, wherein the piston head bearing surface presses on and contacts the piston guide shoe bearing surfaces without the piston head being attached to the piston guide shoes at the piston head bearing surface and/or the piston guide shoe bearing surface, and on the side not bearing on the piston head the piston guide shoe also contacts the eccentric element, and wherein the piston head has an outer shoulder, which is gripped by the device for attaching each of the radial pistons with each of the piston guide shoes.

According to my invention the device for the attachment of the radial piston with the piston guide shoe or shoes comprises a connecting sleeve associated with the individual piston, which embraces with an inner flange the outer shoulder of the associated piston head. The connecting sleeve has a sealing shoulder on its end adjacent the piston guide hose, which fastens on the outside of the associated piston guide shoe and has a spring retaining ring on its end adjacent the radial piston, to which a spring holding ring on the associated radial cylinder is positioned to oppose and correspond, so that between the spring holding ring and the spring retaining ring a compressible spring is positioned, which surrounds the radial cylinder.

According to a preferred embodiment of my invention the connecting sleeve comprises two circular elements, one of which forms the sealing shoulder and is attached to the other element by screws radially directed in relation to the connecting sleeve.

According to my invention the eccentric element can be constructed as an eccentric ring or an eccentric shaft. A preferred embodiment, which is distinguished by an extremely small wear and tear factor and a long useful life of all structural components and in which fatigue fracture problems no long exist, is particularly characterized by the eccentric element being constructed as an eccentric shaft or a plurality of shafts. A plurality of radial cylinders are suitably installed in a single cylinder housing. They are distributed radially around the periphery of the radial piston pump. The compressible spring may be advantageously a coil spring, but can also be other types of springs, e.g. plate springs.

The advantages obtained by the radial piston pump of my invention described at the outset are seen to result from the fact that the guiding connecting rings running around the periphery are no longer required. Instead of these sensitive connecting rings my invention is operated with a connecting sleeve, which can be manufactured without difficulty with high precision and whose tolerances also are not changed in a disturbing manner by long operation of the radial piston pump. The radial piston pump of my invention is characterized therefore, also when it is operated with a high r.p.m., by a long useful life.

Reference herein to a form-locked relation of the head and the shoe signify an interfitting of the two so that the two parts are locked firmly together by virtue of their interengagement. A nonformlocked relation is one in which parts can yieldably bear on one another.

BRIEF DESCRIPTION OF THE DRAWING

The above and other objects, features and advantages of my invention will become more readily apparent from the following description, reference being made to the accompanying drawing in which.

SPECIFIC DESCRIPTION

Figure 1:
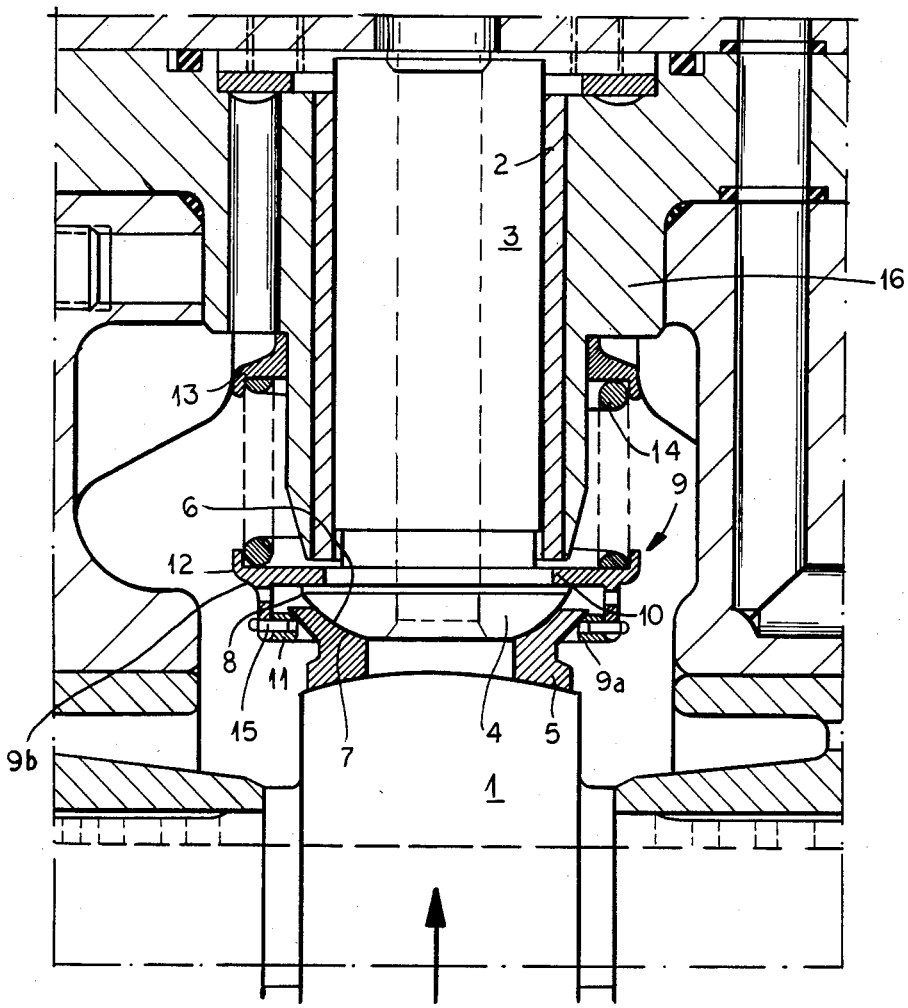
FIG. 1 is a magnified cross sectional view of a preferred embodiment of a radial piston pump according to my invention.

A radial piston pump according to my invention is shown in FIG. 1 in a cross section passing through the axis of an eccentric shaft 1 and the axis of the radial cylinder 2.

Figure 3:
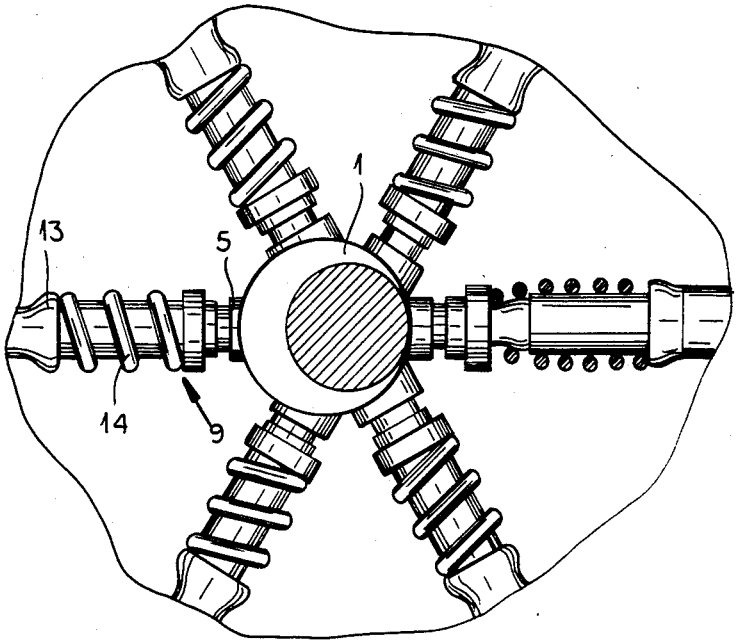
FIG. 3 is a diagrammatic section of a radial piston pump according to my invention showing a plurality of radial cylinders.

It is understood that a plurality of radial cylinders 2 are distributed around the periphery of the radial piston pump as shown in FIG. 3. The radial piston pump shown in FIG. 1 is particularly suited for hydraulic media for control or power purposes. In addition to the radial cylinder 2, the radial piston 3 with its piston head 4, the the piston guide shoe or shoes 5, the eccentric element, which is contructed in this example as an eccentric shaft 1, and a device for attaching the radial piston 3 with the piston cylinder shoe or shoes 5 belong to the basic structure of my invention and are shown in FIG. 1.

The piston head 4 with its bearing surface 6 contacts and presses on the bearing surface 7 of the associated piston guide shoe 5. The piston guide shoe 5 contacts on its other side on the eccentric element 1. The piston head 4 has an outer shoulder 8, which is gripped by the device for holding the radial piston 3 to the piston guide shoes 5. This device comprises a single connecting sleeve 9 associated with the radial piston 3, which embraces with its inside flange 10 the outer shoulder 8 of the associated piston head 4. The connecting sleeve 9 has besides a sealing shoulder 11 on its end adjacent the piston guide shoe or shoes 5, which embraces the outside of the associated piston guide shoe or shoes 5. The connecting sleeve 9 on its end adjacent the radial piston 3 a spring retaining ring 12, to which a spring holding ring 13 on the associated radial cylinder 2 oppose and corresponds. Between the spring retaining ring 12 and the spring holding ring 13 a compressible spring 14 is positioned, which surrounds the radial cylinder 2 and therefore the radial piston 3.

Figure 2:
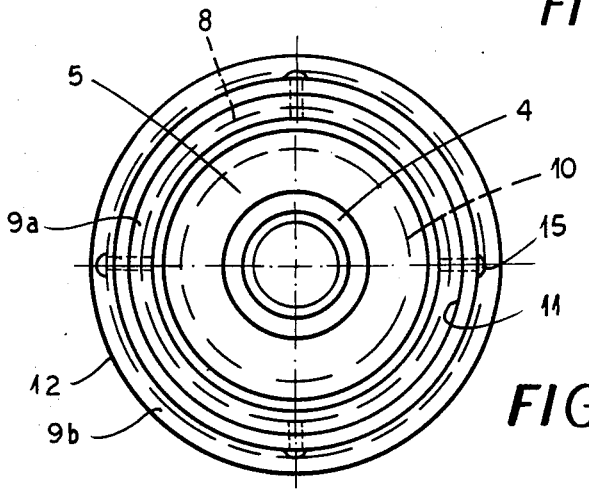
FIG. 2 is a top view of the apparatus according to FIG. 1.

Particularly from a comparative study of FIGS. 1 and 2 it can be seen that the connecting sleeve 9 comprises two circular elements *9a* and *9b*, of which a first one *9a* forms the sealing shoulder 11, and with the other circular elements *9b* is united by screws 15 radially directed in relation to the connecting sleeve 9. Since the eccentric element 1 in this example is constructed as an eccentric shaft 1, the radial cylinders 2 in the form of cylindrical sleeves are installed in the cylinder housing 16, which are distributed radially around the periphery of the entire radial piston pump as shown in FIG. 3.

A second embodiment is shown in FIG. 3 in which the eccentric element 1 is an eccentric ring 1. FIG. 3 also shows the distribution of radial cylinders 2 in the radial piston pump.

I claim:

1. In a radial piston pump having at least one radial cylinder, a piston reciprocable in said cylinder and an eccentric element for reciprocating said piston, the improvement which comprises:

a piston head formed on said piston and formed with an outwardly projecting shoulder having a convex surface;

a shoe having a concave seat receiving said surface in bearing contact therewith and another surface bearing upon said eccentric;

an annular flange connection engaging behind said head and said concave seat for retaining said convex surface in said seat, said flange connection having an annular lip extending away from said eccentric; and a spring received within said lip and bearing upon said flange in the direction of said eccentric, said flange connection comprising a first annular portion formed with said lip and anothr annular portion spaced from said first portion and engaging said seat.

2. The improvement defined in claim 1, further comprising radial screws connecting said portions together.

3. In a radial piston pump, particularly for liquids, comprising at least one radial cylinder, at least one radial piston with a respective piston head, a respective piston guide shoe for said piston head, at least one eccentric element, and a device for attaching each radial piston to the respective piston guide shoe, said piston head having a piston head bearing surface pressing on and in nonformlocking contact with a piston guide shoe bearing surface formed on the respective guide shoe , and said piston guide shoe also contacts said eccentric element on a side of said guide shoe not bearing on said piston head, and wherein said piston head has an outer shoulder which is gripped by said device, the improvement wherein said device for attaching each of said radial pistons with said piston guide shoe comprises a connecting sleeve associated with an individual one of said radial pistons, an inner flange of said connecting sleeve embracing said outer shoulder of said associated piston head, that said connecting sleeve has on a side of said connecting sleeve adajcent said piston guide hose a sealing shoulder which fastens on an outside of said piston guide shoe, and on an end of said connecting sleeve adjacent said radial piston said connecting sleeve has a spring retaining ring, to which a spring holding ring on said associated radial cylinder is postioned to oppose and correspond, so that between said spring holding ring and said spring retaining ring a compressible spring is positioned, which surrounds each radial cylinder, said connecting sleeve having two circular elements, one of which forms said sealing shoulder, and which is attached to the other by screws radially directed in relation to said connecting sleeve.

4. The improvement according to claim 3 wherein said eccentric element is an eccentric shaft.

5. The improvement according to claim 3 wherein a plurality of said radial cylinders are installed in a cylinder housing and are distributed radially about the periphery of said radial piston pump.

6. The improvement according to claim 3 wherein said compressible spring is a coil spring.

* * * * *